US005651354A

United States Patent [19]

La Haise, Sr.

[11] Patent Number: 5,651,354

[45] Date of Patent: Jul. 29, 1997

[54] TWIN LIMB BOW

[76] Inventor: Gerard A. La Haise, Sr., 275 Anthony's Mill Rd., Bechtelsville, Pa. 19505

[21] Appl. No.: 678,853

[22] Filed: Jul. 12, 1996

[51] Int. Cl.[6] ..... F41B 5/00

[52] U.S. Cl. ..... 124/23.1; 124/25.6; 124/88

[58] Field of Search ..... 124/23.1, 25.6, 124/86, 88, 900

[56] References Cited

U.S. PATENT DOCUMENTS

| | | | |
|---|---|---|---|
| D. 282,481 | 2/1986 | Smith | D22/5 |
| D. 361,365 | 8/1995 | La Haise, Sr. | D22/107 |
| 3,397,685 | 8/1968 | Walker | 124/88 |
| 3,517,658 | 6/1970 | Shurts | 124/23.1 |
| 3,538,902 | 11/1970 | Fowkes | 124/88 |
| 3,744,473 | 7/1973 | Nishioka | 124/25.6 |
| 4,252,100 | 2/1981 | Rickard | 124/23.1 |
| 4,287,867 | 9/1981 | Islas | 124/25.6 |
| 4,457,287 | 7/1984 | Babington | 124/23.1 |
| 4,667,649 | 5/1987 | Humphrey | 124/25.6 |
| 4,781,168 | 11/1988 | Lester | 124/25.6 |
| 5,150,699 | 9/1992 | Boissevain | 124/25.6 |
| 5,205,269 | 4/1993 | Guzzetta | 124/25.6 |
| 5,388,564 | 2/1995 | Islas | 124/25.6 |

FOREIGN PATENT DOCUMENTS 1 578 326 11/1980 United Kingdom .

OTHER PUBLICATIONS

The Forward–Handle and Overdraw Bows, Freddie Troncoso, *Bow & Arrow*, Jun., 1992.

Fast Cat—The Martin Jaguar Forward Handle Cam Bow Proves to be a Fast Hunter, C.R. Learn, *Bow & Arrow*, Oct., 1983.

*Primary Examiner*—John A. Ricci

*Attorney, Agent, or Firm*—Richard C. Litman

[57] ABSTRACT

A twin limb bow with adjustable twin limbs and a rotatably mounted hand grip. More specifically, the invention is a compound bow that has a pair of rotatable bow limbs which are rotated when the bowstring is pulled and thereby force a pair of cantilever members to bend and store energy that can be used to project an arrow. The amount of energy stored in the cantilever members and the tension in the bowstring can be varied by adjusting the rest position of the cantilever member. In addition, the twin limb bow of the present invention has means provided which both prevent overdrawing of the bow and offer an infinitely variable let-off. The present invention also includes a forwardly mounted hand grip assembly with a rotatably mounted hand grip which can be slid forward or backward in relation to the bow to create a variety of different draw lengths. The hand grip allows rotation about two axes which prevents torque from being placed on the bow during cocking, thereby preventing a distortion in shooting accuracy. The two bow limbs are synchronized by a timing cable which runs through a channel in the frame of the riser.

9 Claims, 4 Drawing Sheets

TWIN LIMB BOW

BACKGROUND OF THE INVENTION

1. Field of the Invention

The present invention relates to an archery bow that uses a pair of cantilever members to store and release energy for projecting an arrow and has a rotatably mounted hand grip. More specifically, the invention is an adjustable compound bow that allows the archer to vary the power characteristics of the cantilever members and other physical features of the bow in order to maximize the power and accuracy of the bow for any size and skill archer.

2. Description of Prior Art

In the field of archery equipment, the compound bow is preferable over most other bows because of its ability to reduce to some degree the amount of force needed to hold the bow at full draw. This typically gives an archer time to adjust his or her aim, or for the game to move into the archer's line of fire. The degree of force reduction is generally indicated by the percentage let-off such as, for example, a 50% let-off for a draw weight of 60 pounds suggests the archer need only apply force equal to 30 pounds to hold the bow at full draw.

However, it is difficult to design a compound bow which can meet the needs and preferences of every person due to the vast differences in size and strength of individual archers. Different individuals prefer different draw lengths and different bowstring tensions depending on their physical size and the circumstances under which they are shooting. Also a problem may arise if several individuals want to use the same bow and some of them are right-handed and others are left-handed. By creating a bow that can adjust to a wide variety of individuals it is possible to create a single bow with the capability of producing the maximum power and accuracy for each individual who uses the bow.

Consequently, there is a need for a bow which allows the archer to adjust the location of the bow hand grip in relation to the riser and the bowstring in order to adjust the draw-length of the bow. The archer will thereby have the ability to optimize his own level of comfort, power, and accuracy. The bow should permit the archer to quickly and easily adjust the tension in the bowstring and the draw characteristics of the bow. The archer will thereby have the ability to adjust the bow depending on the circumstances of the shot and depending on the strength of the archer. The bow should also provide a means for adapting to be used by either a right-handed or a left-handed archer.

Most conventional compound bows have hand grips that are fixed to the riser thereby creating a high likelihood that a archer will unwittingly draw back the bowstring in an uneven manner. This uneven draw will create torque about the hand grip which will adversely affect the arrow as it is released, thereby creating the potential for inaccurate shots.

Many types of hand grips have been created that are universally mounted on the riser to alleviate the torque about the hand grip. These universally mounted hand grips generally either allow rotation about the axis of the riser or they allow true universal rotation about all three axes. However, rotation about the axis of the arrow is generally not desired because this would create a situation where the riser would tend to want to rotate under its own weight about the axis of the arrow since the hand grip offers no resistance to this rotation. Accordingly, there is a need for a compound bow which also prevents the adverse affects of torque forces about both the axis of the riser and the axis perpendicular to both the axis of the riser and the axis of the arrow.

U.S. Design Pat. No. 282,481, issued on Feb. 4, 1986, to Donald E. Smith discloses a compound bow with a handle oriented forward of the riser. U.S. Pat. No. 4,457,287, issued on Jul. 3, 1984, to Charles E. Babington discloses an archery assembly that includes a handgrip which is universally and adjustably mounted on a bow. Neither of these patents disclose a compound bow with a hand grip that prevents rotation of the riser about the axis of the arrow while allowing rotation about the other two axes.

U.S. Design Pat. No. 361,365, issued on Aug. 15, 1995, to Gerard A. LaHaise, Sr. discloses a compound bow with a handle oriented forward of the riser. The design patent to LaHaise does not disclose a compound bow with a hand grip that prevents the adverse affects of torque forces about both the axis of the riser and the axis perpendicular to both the axis of the riser and the axis of the arrow. Nor does it disclose a bow that permits the archer to quickly and easily adjust the tension in the bowstring and the characteristics of the energy storing member.

U.S. Pat. Nos. 3,397,685, issued on Aug. 20, 1968, to Beeby G. Walker and 4,252,100, issued on Feb. 24, 1981, to Lawrence C. Rickard both disclose a universally mounted hand grip for use with archery bows. Both patents fail to disclose a hand grip that prevents rotation of the riser about the axis of the arrow while allowing rotation about the other two axes nor do they disclose the use of a grip adjustably mounted on a compound bow.

U.S. Pat. No. 3,744,473, issued on Jul. 10, 1973, to Jim Z. Nishioka discloses a compound bow with a pair of rigid rotatable members connected to the bowstring which are rotated when the bowstring is pulled and which thereby force a pair of cantilever members to bend and store energy which can be used to project the arrow. The patent to Nishioka discloses a compound bow with cantilever members that can be adjusted to vary the characteristics of those members, but the process for adjusting the members is awkward and difficult. In order for the archer to adjust the cantilever members he must attempt to hold the cantilever member in position, then he must line up the loop at the end of the linkage with holes on the bow limb, and finally he must place a pin through the hole on the limb. The entire process must then be repeated for the second cantilever member. Because there are only a finite number of holes through which the pin may be inserted, the '473 bow does not possess an infinitely variable let-off. The patent to Nishioka also fails to disclose a hand grip that prevents rotation of the riser about the axis of the arrow nor does it disclose the use of the hand grip adjustably mounted on a compound bow.

U.S. Pat. No. 4,287,867, issued on Sep. 8, 1981, to John J. Islas discloses an archery bow having a riser with upper and lower spring members from which bow limbs are pivotally suspended. The patent to Islas '867 does not disclose a compound bow with a hand grip that prevents the adverse effects of torque forces about both the axis of the riser and the axis perpendicular to both the axis of the riser and the axis of the arrow.

Both U.S. Pat. Nos. 4,667,649, issued on May 26, 1987, to Stanley A. Humphrey and 4,781,168, issued on Nov. 1, 1988, to Wayne L. Lester disclose compound bows which use several resilient cantilever members and a pulley system to store and release power for shooting an arrow. U.S. Pat. No. 5,388,564, issued on Feb. 14, 1995, to John J. Islas discloses a compound bow with a pair of rotatable rigid members which when rotated store energy in a pair of cantilever members and which are synchronized using a timing cable hidden within the frame of the riser. None of these patents disclose hand grips that prevent rotation of the riser about the axis of the arrow while allowing rotation about the other two axes nor do they disclose the use of a grip adjustably mounted on a compound bow. Similarly, neither do French Patent Number 2,304,887, published on Oct. 15, 1976 nor British Patent Number 1,578,326, published on Nov. 5, 1980.

While forward-handles have been used with compound bows before, as seen in *The Forward-Handle and Overdraw Bows,* Freddie Troncoso, *Bow & Arrow,* June 1982, and *FAST CAT—The Martin Jaquar Forward Handle Cam Bow Proves To Be A Fast Hunter,* C. R. Learn, *Bow & Arrow,* October 1983, these articles fail to disclose the benefits of using a rotatably mounted hand grip that prevents rotation about the axis of the arrow.

None of the above inventions and patents, taken either singularly or in combination, is seen to describe the instant invention as claimed. Thus a twin limb bow solving the aforementioned problems is desired.

SUMMARY OF THE INVENTION

The present invention relates to a compound bow with adjustable twin limbs and a rotatably mounted hand grip. More specifically, the invention is a compound bow that has a pair of rotatable bow limbs which are rotated when the bowstring is pulled and thereby force a pair of cantilever members to bend and store energy that can be used to project an arrow. The amount of energy stored in the cantilever members and the tension in the bowstring can be varied by adjusting the rest position of the cantilever member. The present invention also includes a forwardly mounted hand grip assembly with a rotatably mounted hand grip which can be slid forward or backward in relation to the bow to create a variety of different draw lengths. The hand grip allows rotation about two axes which prevents torque from being placed on the bow during cocking, thereby preventing a distortion in shooting accuracy. The two bow limbs are synchronized by a timing cable which runs through a channel in the frame of the riser.

Accordingly, it is a principal object of the invention to provide a compound bow that has the capability to adjust the draw characteristics of the cantilever members and which has fully adaptable physical features to maximize the accuracy and power of the bow for any size and skill archer.

It is another object of the invention to provide a compound bow which prevents the adverse affects of torque about both the axis of the riser and the axis perpendicular to both the axis of the riser and the axis of the arrow.

It is a further object of the invention to provide a bow which allows the archer to adjust the location of the bow hand grip in relation to the riser and the bowstring in order to adjust the draw-length of the bow and thereby optimize the level of comfort, power, and accuracy of the archer.

Still another object of the invention is to provide a bow that will permit the archer to quickly and easily adjust the tension in the bowstring and the draw characteristics of the bow so that the archer can adjust the bow depending on the circumstances of the shot and depending on the strength of the archer.

And finally, another object of the invention is to provide a bow that is capable of adapting to both a right and a left-handed archer.

It is an object of the invention to provide improved elements and arrangements thereof in a twin limb bow for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
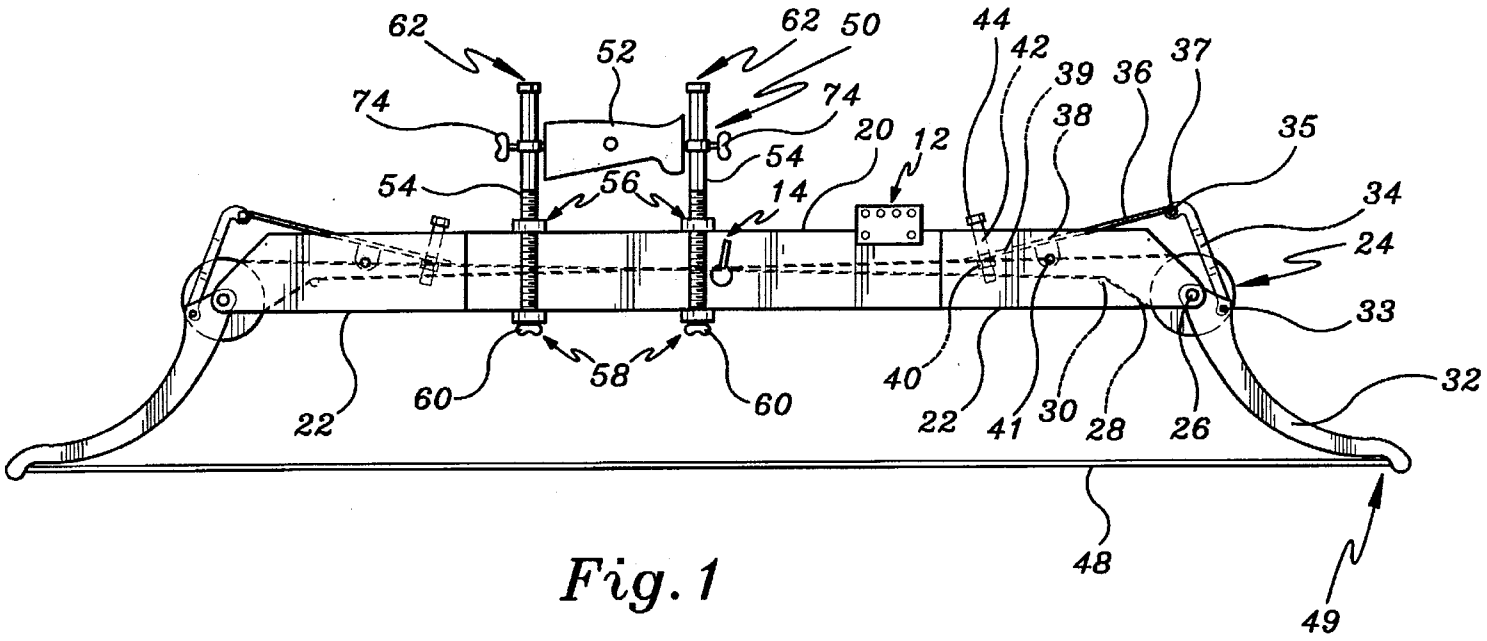
FIG. 1 is side elevational view of the twin limb bow according to the present invention with hidden lines showing the inner structure of the bow.

As shown in FIG. 1, the preferred embodiment of the twin limb bow 10 includes a riser section 20, a pair of rotatable bow limbs 32, a pair of cantilever members 36, a forwardly mounted hand grip assembly 50, and a bowstring 48. Note that the bow limbs 32, cantilever members 36, and all parts associated with these features are identical on both ends of the bow.

Figure 2:
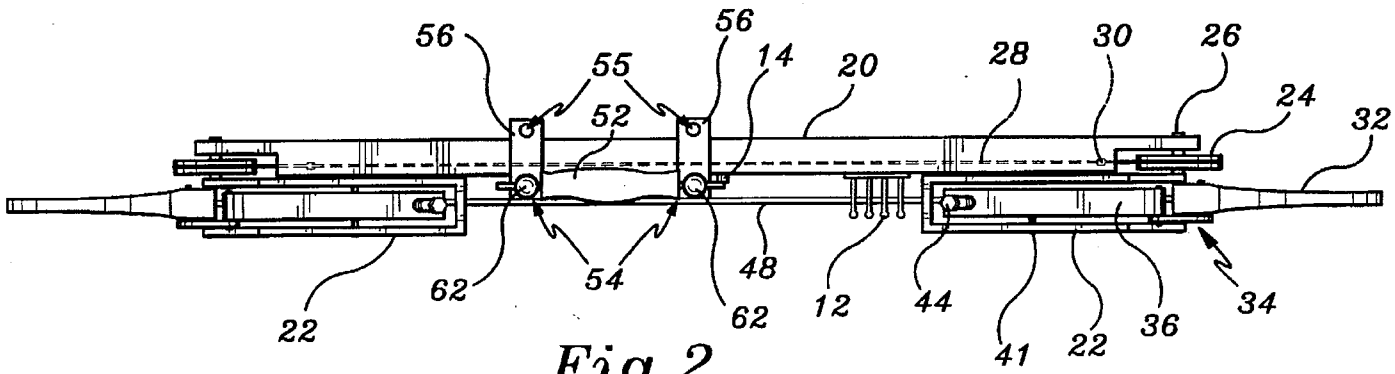
FIG. 2 is a front elevational view of the twin limb bow with the bowstring in the rear.
Figure 3:
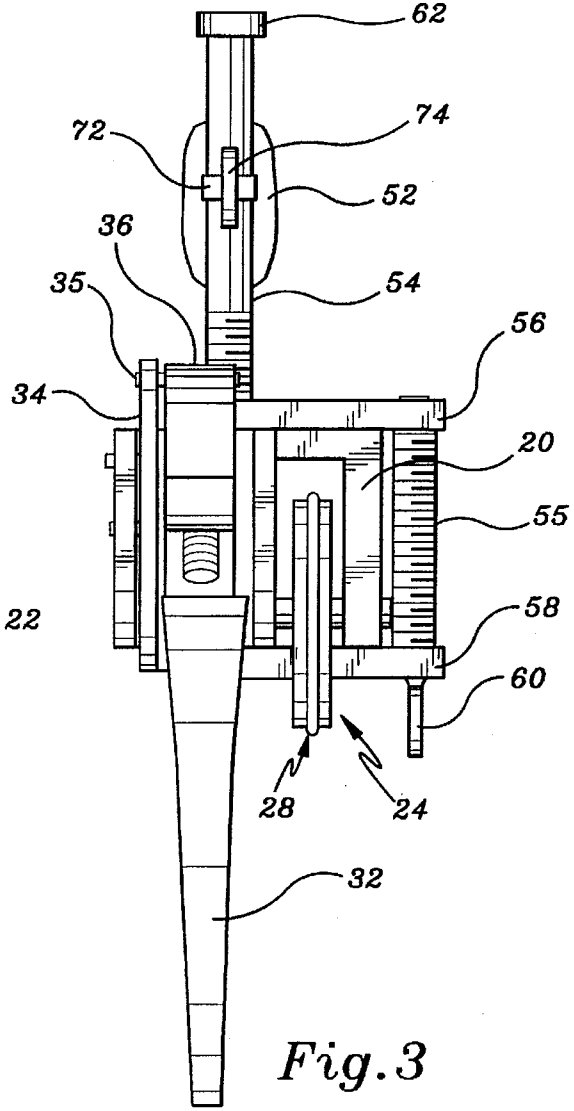
FIG. 3 is an enlarged scale, end elevational view of the twin limb bow.

Referring to FIGS. 1 through 3, the twin limb bow 10 includes a riser section 20 which acts as the frame of the entire unit. The riser section 20 is made from rectangular aluminum tubing which makes the twin limb bow inexpensive to manufacture. The riser section 20 has a pair of support sections 22 attached to each end that hold the bow limbs 32, the cantilever members 36, and the linkages 36. The support sections 22 have a "U" shaped cross-section made from angled sheets of aluminum which again makes them inexpensive to manufacture.

The use of timing wheels on a compound bow can help reduce the possibility that one bow limb may be drawn more than the other which would create an uneven force on the arrow. Consequently, the riser section 20 of the twin limb bow 10 has a pair of timing wheels 24 which are rotatable mounted on the ends of the riser 20 on pins 26. The timing wheels 24 are interconnected by a timing cable 28 which runs over a pair of guiding pins 30 and through the hollow interior channel in the riser. The riser will protect the timing cable and timing wheels from damage. The timing wheels 24 are rigidly connected to the bow limbs 32 so that the bow limbs 32 and the timing wheels 24 rotate about pin 26 in unison.

The timing cable 28 crisscrosses at the center of the riser in order to interconnect the timing wheels in a figure "8" shape such that when one rotates clockwise, the other will rotate counterclockwise in unison. The guiding pins 30 offset the paths of the timing cable 28 so that the timing cable 28 does not interfere with itself at the center of the riser 20. Each guiding pin 30 has a groove (not shown) on it in which the timing cable 28 sits and each groove pulls the timing cable 28 towards an opposite wall of the riser 20, thereby preventing the timing cable 28 from interfering with itself. The tension in the timing cable 28 can be adjusted by a turnbuckle (not shown), or other similar device, to prevent the timing cable 28 from slipping on the timing wheels 24.

The twin limb bow 10 has a pair of bow limbs 32 rotatably connected to the support section 22 of the riser by pin 26. One end of the bow limbs is connected to the bowstring 48 at 49. The bow limbs 32 are made from a generally rigid material. The bow limbs are pivotally connected to linkages 34 by pin 32. The cantilever members 36 of the twin limb bow 10 have a first end section 37, a shaft section 38 and a second end section 39. The linkages 34 are pivotally connected to the first end section of the cantilever members 37 by pin 35. The shaft section of the cantilever members 38 are pivotally connected to the support section 22 of the riser by pin 41. The second end section of the cantilever members 39 are held in a fixed position by adjustment screw 42. The cantilever members 36 are made of a resilient metal.

Figure 4:
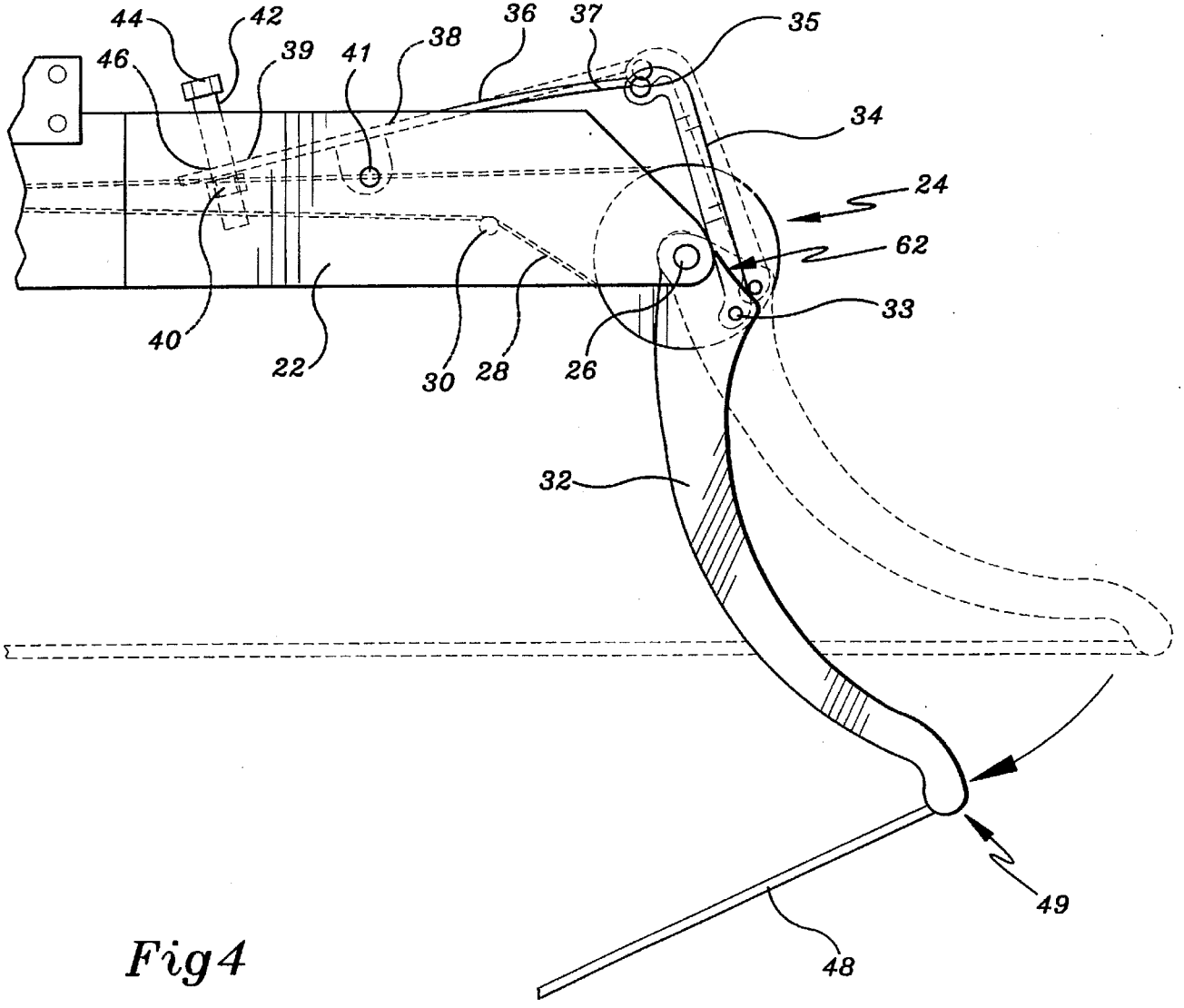
FIG. 4 is an enlarged scale, partial side elevational view of the twin limb bow showing the movement of the limbs when the bowstring is drawn and showing the overdraw prevention mechanism.

FIG. 4 shows the movement of the twin limb bow 10 when the bow string 48 is drawn. When the bowstring 48 is drawn into shooting position it rotates the bow limbs 32 about pin 26. The bow limbs 32 pull the linkage 34 which in turn bends the cantilever members 36 about pin 41. The energy stored in the bent cantilever members 36 can then be used to project an arrow by releasing the bowstring 48.

If the cantilever members 36 are bent beyond a certain point they can lose their resiliency and become permanently deformed. In order to prevent damage to the cantilever members 36 the twin limb bow 10 has a simple and effective mechanism that prevents overdraw of the cantilever members 36. The bow is designed so that when the bowstring 48 is drawn the linkage 34 is rotated until its rotation is impeded by pin 26 as shown in FIG. 4 at 62. This is referred to as the stop point, or positive stop. The location or position of pin 26 with respect to linkage 34 determines the stop point by providing a consistent anchor point to prevent an archer from overdrawing the bow. Pin 26 prevents the linkage 34 from rotating which in turn prevents the cantilever members 32 from bending beyond the point of permanent deformation. The stop point of the bow can be adjusted by changing the interference point of the linkage 34 by placing bushings or shims on or around the pin 26. In addition to the stop point provided by pin 26, adjustment of the interference point between pin 26 and linkage 34 provides an infinitely variable let-off to adapt the bow 10 to the varied needs of most any archer. By adjusting the interference point, the let-off may be adjusted anywhere within the range between zero to one hundred percent.

Figure 5:
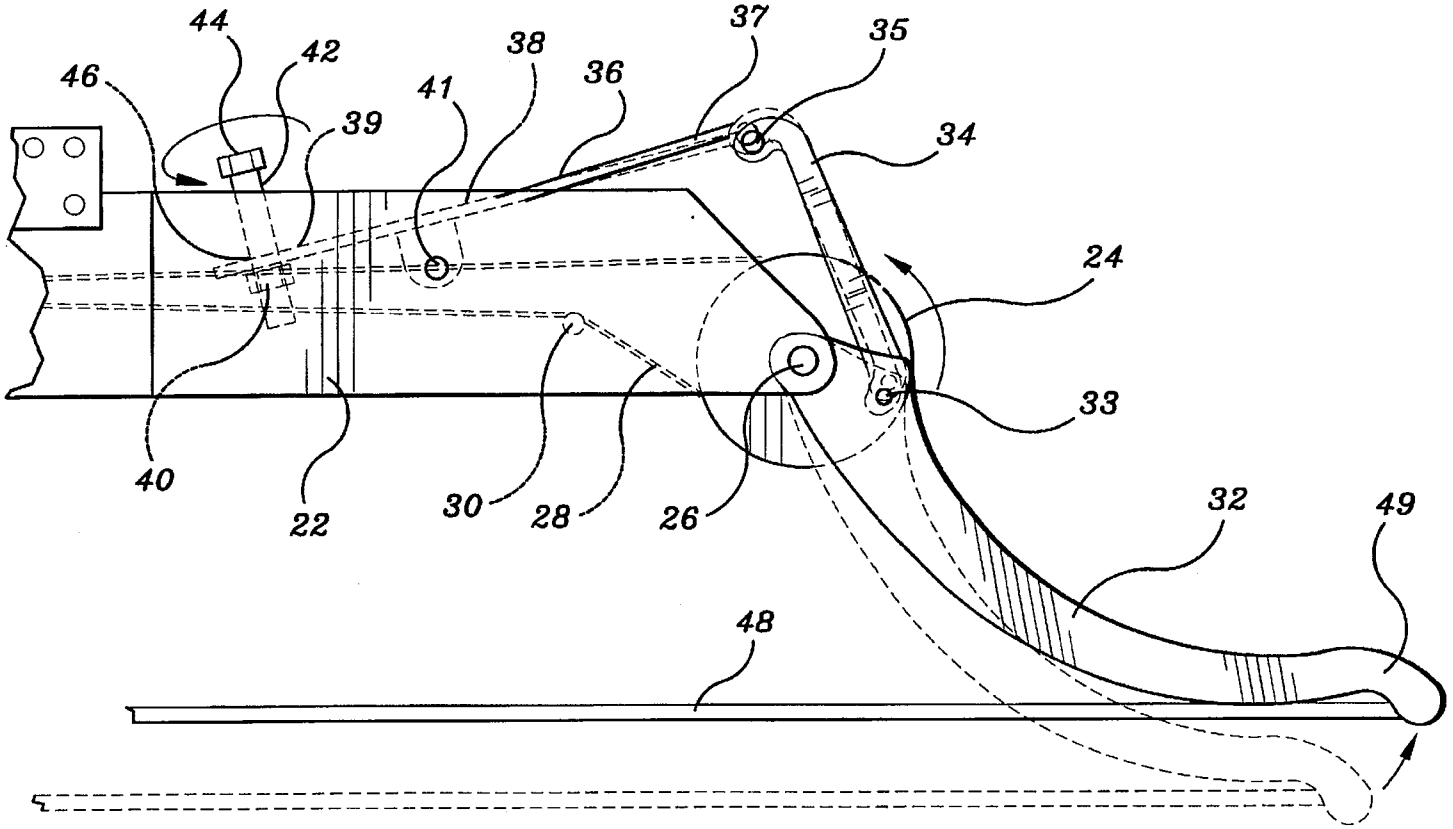
FIG. 5 is an enlarged scale, side elevational view of the twin limb bow showing the mechanism for adjusting the tension in the bowstring.

FIG. 5 shows the mechanism used to adjust the tension in the bowstring 48. The tension in the bowstring 48 can be adjusted by simply rotating the adjustment screw 42 which thereby raises and lowers the second end section of the cantilever member 39 and pivots the cantilever member 36 about pin 41. Block 40 is fixed to the support section 22. Block 40 allows the adjustment screw 42 to freely rotate but prevents the screw 42 from translating through block 40. The section of shaft of adjustment screw 42 in between the block 40 and the screw head 44 is threaded and is threadably engaged with a threaded hole 46 on the cantilever members 36. When the adjustment screw head 44 is rotated the threads on the adjustment screw 42 engage with the threads on the cantilever member 36 and either raise or lower the second end section 39 of the cantilever member 36.

When the second end section 39 of the cantilever member 36 is lowered the bowstring 48 is tightened as shown in FIG. 5. When the second end section 39 of the cantilever member 36 is raised the bowstring is loosened. The tightening of the bowstring 48 may tend to place an initial bend on the cantilever members 36 thereby changing the draw characteristics of the bow.

Referring to FIG. 1, the mid-section of the riser 20 includes sights 12, an arrow rest 14, and a hand grip assembly 50. The hand grip assembly 50 is slidably mounted on the riser 20 by two pairs of plates 56 and 58, a pair of short rods 55, a pair of long rods 54, and two pairs of wing nuts 60. The first pair of plates 56 have threaded holes through them which hold them in position on the long and the short rods 54 and 55 respectively. The second pair of plates 58 have non-threaded holes which slide over the threads on rods 54 and 55 and are held in position by four wing nuts 60. The wing nuts 60 can be loosened which will loosen the second pair of plates 58 and allow the hand grip assembly 50 to be slid into a new position on the riser 20. The hand grip assembly 50 should be mounted below center so that the arrow rest 14 and knocking point (not shown) on the bowstring are centered to eliminate distorted arrow flight. Due to the orientation of the riser section 20 and the support sections 22, both the sights 12 and the arrow rest 14 are well protected from damage.

In order to reposition the hand grip assembly 50 to accommodate a left-handed archer, the sights 12 and the arrow rest 14 must be removed from the riser by loosening the screws (not shown) which connect them to the riser. Then the hand grip assembly 50 can be repositioned by loosening the wing nuts 60 at the base of the hand grip assembly 50 and sliding it into position below center on the opposite side of the arrow rest 14. The arrow rest 14 can then be reattached in the same position as before and the sights 12 can be reattached at the same position but on the opposite end of the riser 20 as before. The hand grip 52 must then be repositioned by removing the pair of end caps 62 which are screwed on the ends of the long rods 54, sliding the hand grip 52 off the long rods 54 and inverting the hand grip 52. The hand grip 52 can then be placed back onto the long rods 54 and the end caps 62 be reattached to the long rods 54. The twin limb bow 10 may then be inverted and used comfortably by a left-handed archer.

Figure 6:
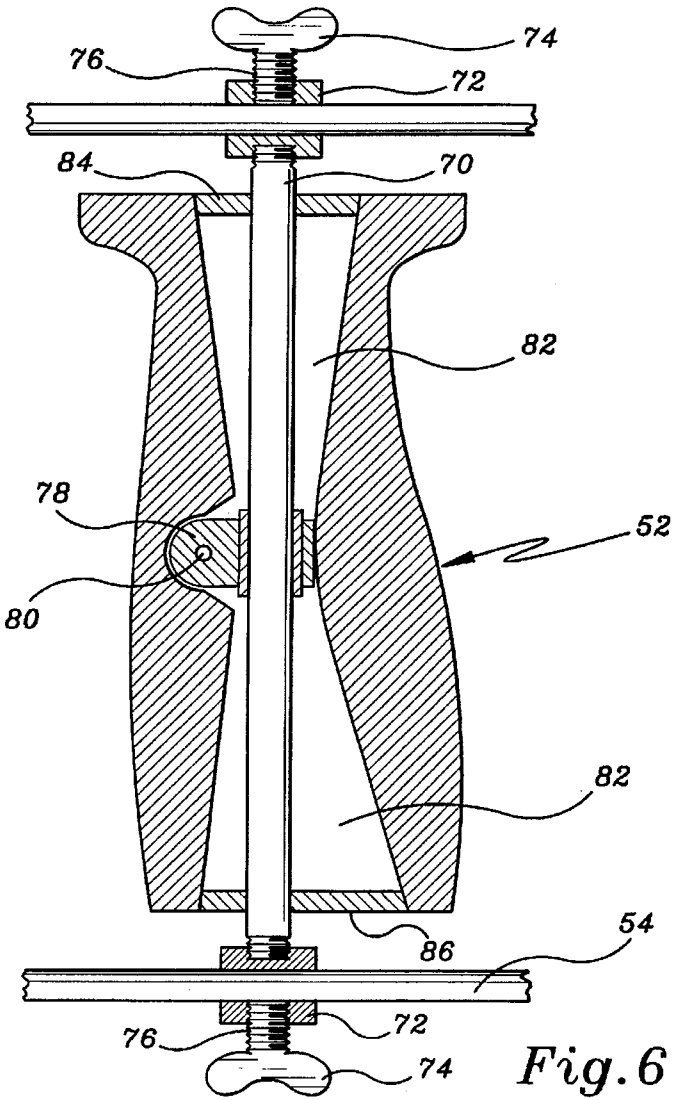
FIG. 6 is an enlarged scale, side cross-sectional view of the hand grip.

The hand grip 52 is slidably mounted on the long rods 54 to allow for adjustment of the draw length, as shown in FIG. 6. The hand grip 52 is mounted on a rod 70 which is connected to a pair of sleeves 72 that are slidably mounted on the long rods 54. The sleeves 72 have thumb screws 74 which extend through a hole 76 in the sleeves 72 and contact the long rods 54 thereby locking the hand grip 52 in position on the long rods 54.

The hand grip 52 is connected to the rod 70 by a coupling 78 which allows the hand grip 52 to rotate about rod 70 and to rotate about pin 80. Notice that the coupling 78 does not allow the hand grip 52 to rotate about an axis parallel to the long rods 54. The coupling 78 allows the hand grip 52 to freely slide around and along the rod 70. The coupling 78 also allows the hand grip 52 to pivot around pin 80. The open areas 82 within the hand grip 52 allow the handle to pivot around pin 80 to eliminate any torque that the archer may unwittingly place on the handgrip during drawing of the bowstring 48. Rubber grommets 84 and 86 have been placed over the openings in the hand grip around the rod 70. The grommets 84 and 86 eliminate vibration in the hand grip 52 when an arrow is fired from the twin limb bow 10.

It is to be understood that the present invention is not limited to the sole embodiment described above, but encompasses any and all embodiments within the scope of the following claims.

I claim:

1. A twin limb bow comprising:

a rigid riser section having a channel running through the length of said riser;

a pair of rotatable bow limbs, said bow limbs being rotatably connected to the ends of said riser section;

a bowstring connecting the free ends of said bow limbs;

a pair of resilient cantilever members, each said cantilever member having a first end section, a shaft section, and a second end section wherein said first end section is pivotally connected to said rotatable bow limb by a linkage, said shaft section is pivotally connected to said riser section, and said second end section is adjustably connected to said riser section to allow for adjustment of tension in said bowstring; and means passing through said channel and interconnecting said bow limbs for causing said bow limbs to rotate in unison and in opposite directions when said bowstring is drawn.

2. The twin limb bow as defined in claim 1 further comprising a hand grip mounted on said riser section, said hand grip having means for permitting said hand grip to rotate about two axes but prohibiting rotation about the axis of an arrow when the arrow is in position to be fired from said bow.

3. The twin limb bow as defined in claim 2 further comprising a pair of beams mounted to said riser, said beams extending along the axis of an arrow when the arrow is in position to be fired from said bow, said beams extending away from said riser and towards the tip of the arrow, said hand grip being mounted on said beams.

4. The twin limb bow as defined in claim 3 wherein said hand grip is slidably mounted on said beams thereby allowing the distance from said riser to said hand grip to be adjusted, said hand grip having locking means to fix the position of said hand grip after adjustment.

5. The twin limb bow as defined in claim 4 wherein said hand grip and said beams have means for repositioning said hand grip and said beams to accommodate either a left-handed archer or a right-handed archer.

6. The twin limb bow as defined in claim 5 wherein said handgrip includes means for preventing vibration of said hand grip when an arrow is fired from said bow.

7. The twin limb bow as defined in claim 1 wherein said linkage is dimensioned and configured so as to be interfered with by said rotatable connection of said bow limbs when said bowstring is fully drawn thereby preventing overdraw of said cantilever members.

8. The twin limb bow as defined in claim 7 further comprising a means for adjusting the draw length of said bowstring by modifying the position at which said linkage is interfered with by said rotatable connection of said bow limbs.

9. The twin limb bow as defined in claim 1 wherein said riser is constructed of rectangular aluminum tubing.

* * * * *